United States Patent [19]

Bartizal, Jr.

[11] 4,355,799

[45] Oct. 26, 1982

[54] SHEET STREAM SENSING AND CONTROL DEVICE

[76] Inventor: John J. Bartizal, Jr., 1015 W. 61 St., Lisle, Ill. 60532

[21] Appl. No.: 146,307

[22] Filed: May 5, 1980

[51] Int. Cl.[3] ..... B65H 1/22

[52] U.S. Cl. ..... 271/151; 271/258; 271/265

[58] Field of Search ..... 271/149, 150, 151, 258, 271/259, 265

[56] References Cited

U.S. PATENT DOCUMENTS

| | | | |
|---|---|---|---|
| 567,994 | 9/1896 | Oder | 271/258 X |
| 2,133,726 | 10/1938 | Staude | 271/151 UX |
| 2,660,430 | 11/1953 | Ribich | 271/151 X |
| 3,287,015 | 11/1966 | Preuss | 271/259 |
| 4,240,539 | 12/1980 | Klapp | 198/577 X |

*Primary Examiner*—Richard A. Schacher
*Attorney, Agent, or Firm*—Roger N. Chauza

[57] ABSTRACT

A sheet stream sensing and control device for use in sheet feed systems having a motor driven conveyor transport means for advancing a reclining underlapped sheet stream toward a sheet removal means whereby the sheets are individualized and delivered to an operation such as a folding machine. The sensing and control device rests, vertically unconstrained, in a quiescent operating position upon the sheet stream and is responsive to the gradient of the surface discontinuity formed where the upper exposed surface of the foremost sheet joins the subsequent underlapped sheets. Conveyor control is effected when sheet stream advancement causes the surface gradient in the area of the discontinuity to exert pressure on the device electrical switch means to thereby deactivate the motor and interrupt sheet stream advancement. The sheet removal means continues to deplete the halted sheet stream thereby removing the switch pressure to energize the conveyor motor and advance the sheet stream.

3 Claims, 9 Drawing Figures

SHEET STREAM SENSING AND CONTROL DEVICE

BACKGROUND OF THE INVENTION

The present invention relates in general to sheet feed systems and in particular to methods and apparatus for sensing and controlling the sheet stream flow in a system having a conveyor transport means upon which an array of reclining underlapped sheets are fed to thereupon be printed, folded, collated, etc. Although susceptible to use in label applicating machines and the like, the methods and apparatus will find especially advantageous applications in the printing, binding, advertisement and leaflet processing industries.

In automatic and semiautomatic document processing systems the flow of sheets fed thereto must be carefully and accurately controlled in order that the process may continue at optimum speed uninterrupted by an inadequate supply of paper. Because of the high speed nature of machines used in industries such as the printing, binding and folding industries, there is a necessity for an orderly sequential flow of sheets fed to the machine such that the individual sheets may be quickly operated upon in a sequential manner.

Conventional approaches for supplying a continuous stream of underlapped sheets to an operation include arraying the sheets on a conveyor in a manner in which the foremost sheet is fully exposed to the operation and each subsequent sheet lies virtually under the sheet in front of it. The reclining stream of sheets lie at a small angle with respect to the conveyor whose movement is directed toward the operation.

Rotating pneumatic suction wheels of various types are typically placed in the path of the stream of advancing sheets such that the stream of underlapped sheets becomes "individualized" by the action of the suction wheel which lifts off the foremost sheet and presents it to the particular operation being performed. An airstream is often directed upwardly, from beneath, toward the frontal edges of the sheet stream in order that the foremost sheet is easily separated from the subsequent sheets. It must be appreciated that because the document removal rate cannot be exactly synchronized with the sheet stream advancement rate, there must be a method of sensing the sheet stream position and controlling the conveyor speed in order that the foremost sheet in the stream is always in close proximity to the pneumatic suction wheel such that the suction can properly lift the sheet and quickly remove it from the sheet stream. In the event the arrayed sheets advance too far the pneumatic sheet removal means will not be effective in removing the sheets quickly enough and the machine will bind. If the stream of sheets advance too slowly the operation will suffer efficiency because of an inadequate sheet supply to the pneumatic suction wheel and thus operating machine cycles will be lost.

The prior art encompasses methods and apparatus for sensing and controlling the advancement of a stream of sheets by first detecting the leading edge of the foremost sheet by an electrical pressure sensitive conveyor motor switch. As the flow of sheets advance, the leading edge of the foremost sheet activates the switch in which event the conveyor transport movement is interrupted. The pneumatic suction wheel continuously removes sheets and eventually actuates the switch to thereby cause the conveyor to advance the sheet stream forward again. Typically, a pressure sensitive miniature switch is employed to sense the leading edge of the foremost sheet. The switch contact closure generally controls the conveyor motor or in the alternative controls another relay which in turn has the electrical current capability to control the conveyor motor current. This method of sensing the position of the stream of sheets has been found to be unsatisfactory because the available switches necessarily depend upon the rigidity of the paper to overcome the activation force of the electro-mechanical switch. Because sheets lying one on top of another have a tendency to adhere to each other a stream of forced air is directed from beneath in an upwardly manner in a effort to reduce sheet adhesion. However, this air stream tends to cause sheet vibration and thus interfers with the switch activation. In addition, if the leading edges of the sheets happen to be warped, bent or curled the switch would be completely inoperative to detect the frontal edge and the machine operation would be hampered. In the event machine operations are interrupted by a bind or jam, manual intervention is necessary thereby involving additional cost and labor.

SUMMARY OF THE INVENTION

The primary aim of the present invention is to provide a device for controlling the advancement of a sheet stream toward a sheet removal means by sensing the sheet stream position near the surface discontinuity formed where the upper surface of the foremost sheet joins the upper edges of the subsequent underlapped sheets.

It is another object of the present invention to provide a sheet stream sensing and control device where the sensing point of such device, being on the surface of the sheet stream, is insensitive to the irregularity of sheet edges and insensitive to sheet vibration due to the forced air stream used at the frontal sheet edges.

As a corollary to the foregoing, it is an object of the present invention to provide a sheet stream sensing and control device which rests upon the sheet stream but is yet insensitive to irregularities of sheet thicknesses.

It is yet a further object of the present invention to provide a sheet stream sensing and control device which rests upon the sheet stream yet is insensitive to the thickness of the underlapped sheet stream itself.

It is a related object of the present invention to provide a sheet stream sensing and control device which is easily adjustable horizontally to thereby move the quiescent operating position of the sheet stream toward or away from the sheet removal means. .

It is an alternative object of the present invention to provide a sheet stream sensing and control device where the sensing point is on the upper edges of the subsequent underlapped sheets.

Still another object of the present invention is to provide a sheet stream sensing and control device which can be used in pairs to control sheet stream advancement in a continuous flow variable speed sheet feed system.

It is a coordinate object of the present invention to provide a sheet stream sensing device which monitors the sheet stream to give an indication if the sheet stream discontinuity peak passes a predetermined point.

DESCRIPTION OF THE DRAWINGS

The invention itself will be better understood and further objects and advantages will become apparent when the following detailed description is read in conjunction with the attached drawings, in which.

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of the invention as defined in the appended claims.

DETAILED DESCRIPTION OF THE ILLUSTRATED EMBODIMENT

Figure 1:
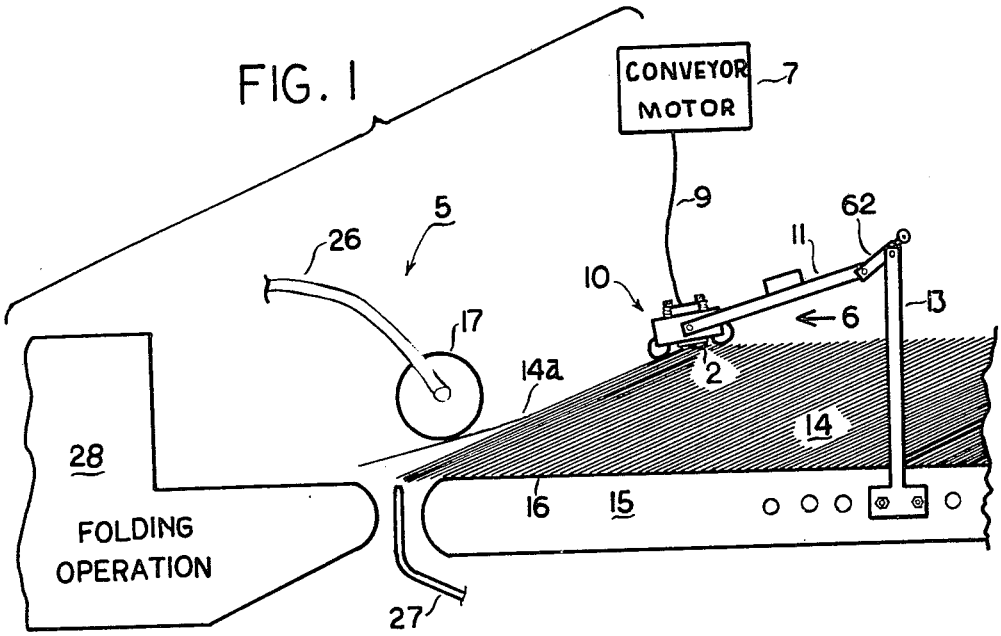
FIG. 1 is a generalized view of a sheet feed system illustrating the operating position of the sensing and control device upon the sheet stream in a position straddling the surface peak discontinuity.

To provide background environment, FIG. 1 illustrates a simplified and well-known sheet feed system in which the apparatus and methods of the present invention will be embodied and practiced. Such a system includes a motor driven conveyor transport means wherein the motor is controlled to start and stop the conveyor on demand. Because the sheet stream advancement rate cannot be exactly synchronized with the sheet removal rate, the conveyor advancement rate is purposefully made greater than the removal rate. An adjustment in the advancement is made by interrupting the sheet stream flow until the sheet removal means has depleted the sheet stream by an amount which necessitates sheet stream advancement.

The illustrated embodiment is particularly useful in applications where the advancement of the sheet stream 14 is controlled by a sensing and control device 10 which detects both the forward movement of the sheet stream in a direction indicated by the arrow 6, due to conveyor movement, and the apparent sheet stream movement in the opposite direction due to the sequential removal of sheets. The invention will be described hereinafter in terms of applications involving paper sheets, but it should be noted that the invention can be adapted equally well to similar applications involving sheets of both paper and similar non-paper material.

Referring now to FIG. 1 there is shown a sheet operation 28 such as a paper folding machine 28 which accepts individual sheets of paper 14*a* in a serial fashion and operates upon the sheets to perform the folding operation. The sheet supply 14 is manually placed on the conveyor transport belt 16 in an underlapped reclining fashion where the reclining angle between the conveyor and the paper is substantially less than a right angle. In the particular embodiment shown in FIG. 1, the conveyor motor activates the conveyor transport means to advance the sheet stream in a direction toward the sheet removal means 5. The sheet stream sensor and control device 10 is adjustably fixed to the conveyor frame 15 a distance of somewhat less than the length of the sheet material being used. The sheet removal means 5, not forming a part of the present invention, may be of the pneumatic vacuum operated type which includes a rotating wheel 17 having air inlet holes spaced around the outer peripheral surface of the wheel. Not shown is apparatus connected to the wheel which rotates the wheel at a predetermined speed sufficient to supply sheets to the particular operation 28 to be performed upon the sheets. The holes in the peripheral surface of the wheel are connected to a source of vacuum via an air tube 26. Also, to simplify the figure, the rotating sheet removal wheel 17 is fixed to the conveyor by apparatus not shown. Generally, the quiescent operating position of the sheet stream is maintained such that the sheet removal wheel is about one-half inch above the sheet stream surface.

It can further be observed from FIG. 1 that as the foremost sheet 14*a* of the advancing stream 14 comes within the vicinity of the removal wheel 17 the vacuum will attract the sheet, slide it along the upper surface of the sheet thereunder and deliver it to the folding operation. There is also shown in FIG. 1, a source of forced air pressure 27, directed from beneath, toward the foremost sheets in an effort to reduce the adhesion forces which exist between stacked sheet material to thereby reduce the possibility of pulling a double sheet. Further discussions of the cooperation between the sheet folding operation 28 and the sheet removal wheel 17 is not necessary to the understanding of the sheet stream sensing and control device 10 of which a description ensues.

To control conveyor movement and thus the sheet advancement, the sensing and control device 10 is responsive to the sheet stream discontinuity formed where the foremost sheet upper surface meets the subsequent underlapped sheet upper edges 2. The portion of the sheet stream in the general area of this discontinuity shall hereinafter be referred to as the sheet stream "discontinuity peak" or simply "peak." It should also be noted that for a better understanding of the invention, the inner angle intercepted by the peak, as shown, may be smaller than that existing in actual practice. The angle forming the peak in actual operation may be greater than 150 degrees indicating the sheets are lying in a more horizontal position. The peak angle is, however, entirely dependent on the manner in which the sheets are arrayed. The sensor device 10 is electrically connected to the conveyor motor 7 via electrical wires 9 which transmit the sensor switch contact activity indication to the motor thereby starting or stopping the conveyor belt 16.

Importantly, it should be realized that when the conveyor belt movement is interrupted, the peak 2 appears to moves in a direction opposite the arrow 6 because of the action of the sheet removal wheel 17 depleting the sheet stream. The sensor device 10 is connected to the conveyor transport frame 15 by way of a linkage arm 11 (pivotally connected at both ends) and a short connecting arm 62 also connected to a member 13 which is in turn adjustably fixed to the transport frame 15. Pivotal action allows the sensor device 10 to move in a vertical direction to accommodate the various angles at which the sheets are stacked and also the vertical thickness of the sheet stream.

In accordance with a primary aspect of the present invention the sensor device 10 is provided to detect the forward and backward movement of this peak 2 to thereby control the conveyor motor power.

Figure 2:
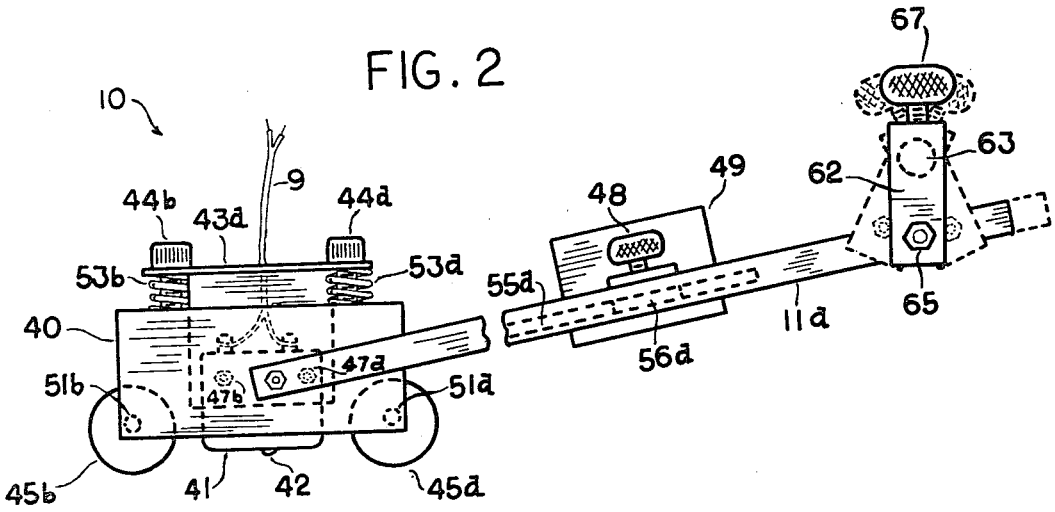
FIG. 2 is a side view illustrating the details of the sheet sensing and control device with the connecting linkage.

Turning now to FIG. 2 there is shown in detail the sheet stream sensing and control device 10 and the associated connecting linkage. As an integral part of the illustrated embodiment there is provided a miniature electrical pressure sensitive switch 41. One of the many electrical switches suitable for this application is the Micro switch part number 11SM1, obtainable from Micro Switch, Freeport, Ill. 61032. It should be noted that there exists many other switches that are equally suitable for this application. The electrical switch 41 is fastened between two plates by way of two fastening screws 47*a*,47*b*. One plate 43*a* of the pair is shown in FIG. 2. The device frame block 40 is machined or molded with a void extending through the frame block 40 to freely accept the electrical switch 41 and mounting plates 43*a*,43*b*. The combination plates 43*a*,43*b* and switch 41 is adjustably mounted to the frame block 40 with two compression springs 53*a*,53*b* and two associated adjusting screws 44*a*,44*b*. Viewing FIG. 3 in conjunction with FIG. 2 it can be seen that only one hole, and thus one adjusting screw, is used with each fastening plate 43*a*,43*b*. It should also be observed from these figures that the two adjusting screws 44*a*,44*b* are diagonally displaced such that only two screws provide multiple switch position adjustments within the frame block 40 to thereby accommodate the sheet stream discontinuity peak 2 whose cooperation with the switch activation member 42 will be described hereinbelow.

There are are provided two support rollers 45*a*,45*b* which allow the sensor and control device 10 to rest on the sheet stream surfaces. In the illustrated embodiment, the front support roller 45*b* rests on the foremost sheet 14*a* as shown in FIG. 1 and the rearmost support roller 45*a* rests on the top edges of the subsequent underlapped sheets. The support rollers 45*a*,45*b* shown are of the solid construction type axially pinned to the frame block 40 by the pins 51*a*,51*b*. The support rollers 45*a*,45*b* could as well be of the ball or roller bearing type. Also, the supports could be any surface rigidly fixed to or formed as part of the frame block 40 which surface is made of or coated with a friction-reducing material. The rollers 45*a*,45*b* provide a means of reducing friction and drag on the sheets produced by the weight of the device 10 upon the sheet stream. Additionally, the rollers 45*a*,45*b* serve to flatten or straighten any curl or irregularity of the sheet edges. Significantly, the support rollers serve to maintain a reference level above the sheet stream surface for cooperation between the discontinuity peak 2 and the switch activation element 42.

The amount of pressure the rollers 45*a*,45*b* bear on the sheet stream surfaces can be varied by an adjustable ballast weight 49 (FIG. 2) to be discussed in detail later. The ballast allows the device 10, which is typically constructed of metal, to be easily and economically molded out of a lighter material such as plastic. The electrical contact wires 9, exiting from the frame block 40 top, are preferably of the flexible stranded type which will allow the device 10 to move vertically to accommodate the various thicknesses of sheet streams.

Figure 3:
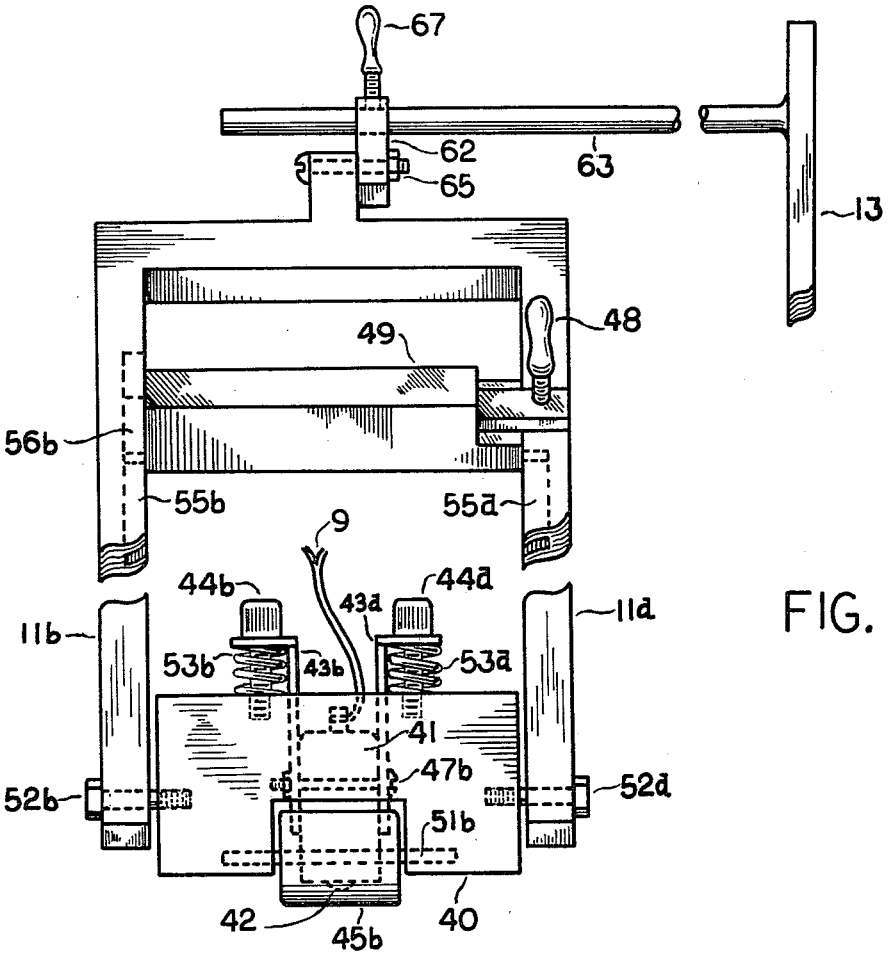
FIG. 3 is a detailed partial perspective view showing the relative position of the sensor device elements and the connecting linkage.

The frontal perspective view of the sensor and control device 10 and its associated connecting linkage is illustrated in FIG. 3. In particular, the electrical switch 41 is shown sandwiched between the fastening plates 43*a*,43*b*. The plates are in turn adjustably mounted to the frame block 40 by way of the adjusting screws 44*a*,44*b* and the compression springs 53*a*,53*b* as specifically described hereinbefore. As can be envisioned, when the adjusting screws 44*a*,44*b* are loosened, the compression springs lift the switch 41 to accommodate a more "peaked" discontinuity.

In accordance with another aspect of the present invention there is provided linkage means connecting the sensing and control device 10 with respect to the sheet removal means 5. While various other arrangements may be of similar advantage the illustrated arrangement as noted in FIG. 3 provides two pivotal points. A first pivotal point exists about the screw 65 which connects the linkage arm 62 and members 11*a*,11*b* thereby allowing the device 10 to operate at various vertical positions to thereby accommodate various sheet stream thicknesses. FIG. 2 also illustrates this aspect. A second point of pivotal action exists about the screws 52*a*,52*b* which connect the respective linkage members 11*a*,11*b* to the device body 40 thereby allowing the switch means 10 to follow the sheet stream surfaces in the area of the discontinuity peak 2. This latter aspect will be discussed in more detail in connection with FIGS. 5 and 6.

Viewing FIGS. 2 and 3 there is shown a short connecting arm 62 connecting the linkage arms 11*a*,11*b* to structure which is adjustably fixed with respect to the conveyor transport means 15. The above referenced short arm 62, which is adjustably fixed to a connecting element 63, is provided for use in setting the quiescent horizontal operating position of the sensor and control device 10 and thus the sheet sream operating position with respect to the sheet removal means 5. The horizontal position is typically adjusted by loosening the thumbscrew 67 and rotating the short arm 62 toward the sheet removal means 5 or away from the sheet removal means 5. The former direction is set for use with short sheet lengths and the latter direction set for longer sheet lengths. In the operating mode the thumbscrew 67 is secured to the linkage support member 63 such that the short linkage arm remains immovable.

The linkage supporting member 63 in FIG. 3 is shown fixed to the vertical support member 13 (FIGS. 1 and 3) which in turn is adjustably fixed to the conveyor frame 15 the purpose of which is to provide for gross adjustments thereof.

Referring yet to FIGS. 2 and 3 there is shown a ballast weight means 49 adjustably fastened to the connecting linkage members 11*a*,11*b*. While other ballast adjustment methods may be devised by those skilled in the art the illustrated embodiment provides for a slideable tongue and groove type arrangement. The connecting members 11*a*,11*b* have grooves 55*a*,55*b* machined within the inner facing member surfaces to accept the tongue 56*a*,56*b* portion of the ballast means 49. This adjusting arrangement allows the ballast weight 49 to be positioned along the length of the connecting members 11*a*,11*b*, and fixed by thumbscrew 48, to vary the pressure of the sensing and control device 10 to thereby accommodate various sheet textures and rigidities. Additionally, another advantage gained by the provision of the ballast weight 49 is that the sensing and control device 10, which is typically constructed of metal, may be easily and economically molded of a lighter material such as plastic.

The various methods of securing pivotal connections have been discussed in terms of screws, however, any pinned arrangement would by equally effective.

Summarizing, and in accordance with various aspects of the invention, the linkage arrangement allows the sensor device 10 to follow the sheet surfaces in any reclining underlapped sheet stream whose stack thickness may vary vertically.

While these elements connecting the sensor switch assembly are described only in terms of the illustrated embodiment, other connecting arrangements may be envisioned by those skilled in the art to achieve the same results. For example, the sheet stream sensor and control device 10 may be constrained horizontally and movable in the vertical direction by housing the device 10 in a framework similar to an elevator in an elevator shaft. It is equally essential to realize that the sensing and control device 10 need not be fixed to the conveyor frame proper, but rather could be fixed to any structure that is horizontally stationary with respect to the sheet removal means 5.

Figure 4:
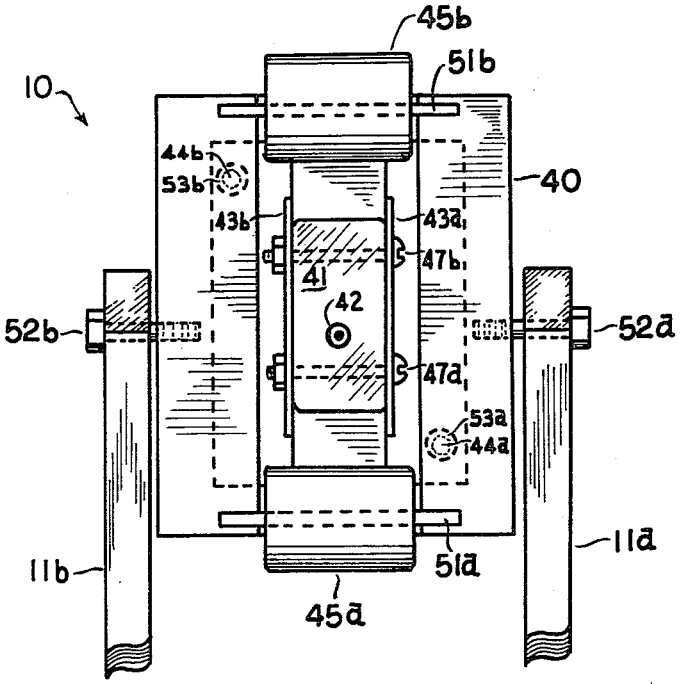
FIG. 4 is a detailed bottom view illustrating the relative position of the electrical switch assembly within the block.

Turning now to FIG. 4 there is shown a bottom view of the sheet sensing and control device 10 which illustrates the frame block construction. The frame block 40 is machined or cast, within its central portion, to accommodate the combined adjusting plates 43*a*,43*b* and electrical switch 41 in addition to the support rollers 45*a*,45*b*. The two switch plate fastening screws 44*a*,44*b* are shown diagonally displaced on the frame block 40 to provide multiple switch 41 adjustments. The support roller pins 51*a*,51*b* are recessed into machined areas within the frame block 40 and are prevented from rotating within the block by a force fit. The rollers 45*a*,45*b*, however, freely rotate on the respective pins 51*a*,51*b*.

Having described the construction of the sensing and control device 10 and its connection with respect to the conveyor transport frame 15, the device's ability to sense the precise position of the sheet stream will be discussed in conjunction with FIGS. 5 and 6.

As previously noted, particular utility is obtained by the thumbscrew 67 adjustment which allows the short connecting arm 62 to be rigidly fastened to arm 63 (FIGS. 2,3). These variable positions of arm 62 are shown by the dotted lines in FIG. 2. In essence, this adjustment allows the operation of the sensor device assembly 10 to be adjustably shifted toward or away from the sheet removal means 5 as may be envisioned in FIG. 1. This aspect of the invention provides a means for adjusting the quiescent operational position of the sheet stream under the sheet removal wheel 17 to thereby adjust the sheet delivery level and position to the folding operation.

Figure 5:
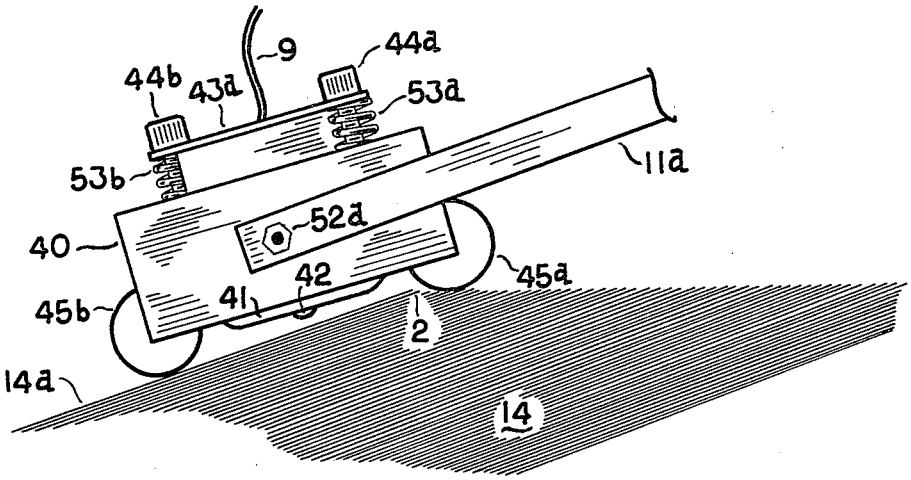
FIG. 5 is a simplified side view showing the sensing and control device resting on a depleted sheet stream in a position whereby the device activates the conveyor motor to thereby advance the sheet stream.
Figure 6:
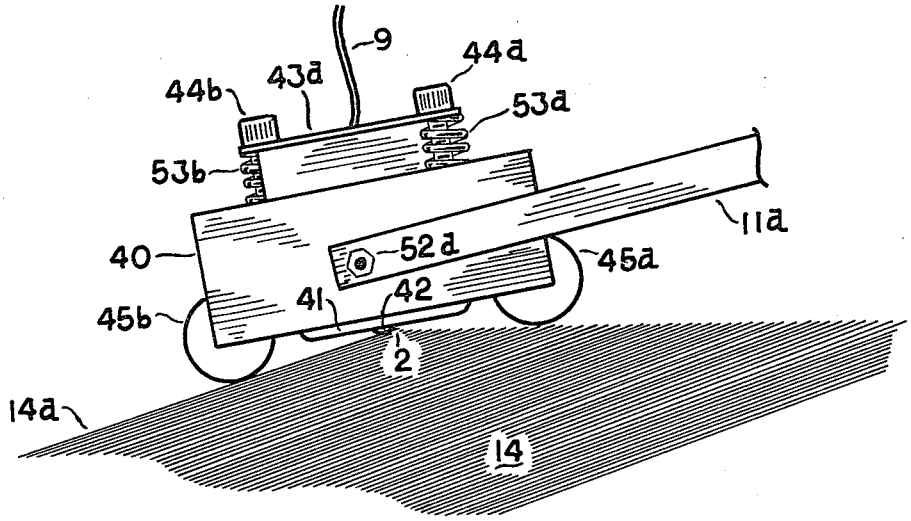
FIG. 6 is a simplified side view illustrating the sensing and control device resting on the sheet stream in a position whereby the device deactivates the conveyor motor to thereby stop sheet stream advancement.

FIG. 5 depicts a simplified version of the sensor device 10 in one of the possible operational positions upon the sheet stream discontinuity peak 2. As illustrated, the peak 2 is formed where the foremost sheet upper edge joins the subsequent underlapped sheet upper edges. The horizontal position of the peak 2 determines the position of the foremost sheet 14*a* in respect to the pneumatic sheet removal wheel 17. The optimal operational position of the pneumatic wheel 17 upon the frontal surface of the foremost sheet 14*a* depends upon various considerations such as the particular thickness and composition of the sheet material being used. The sensor device 10 can be horizontally adjusted via the angle of the linkage member 62 (FIG. 2) whereby the horizontal quiescent operating position of the sheet stream, under the sheet removal wheel 17, produces the best efficient feed to the particular operation being performed.

The sensor device assembly 10, is shown in FIG. 5 in a position after the sheet removal means 5 has removed a sufficient number of foremost sheets 14*a* such that the electrical switch activation member 42 is fully extended. In this switch position, the switch activation element 42 closes the switch internal contacts thereby energizing the conveyor motor 7 to move the sheet stream in a forwardly direction (arrow 6 in FIG. 1). Observing FIG. 5, it can be seen that the proper vertical adjustment of the electrical switch 41 in relation to the rollers 45*a*,45*b* is essential. The electrical switch 41 is adjusted vertically within the frame block 40 by way of screws 44*a*,44*b* in such a position that the surface gradient of the sheet stream peak 2 activates and deactivates the switch activation element 42 as the sensor switch 10 assembly is manually rolled back and forth across the discontinuity peak 2. In the energized condition, the conveyor motor 7 moves the conveyor belt 16, and thus the sheet stream 14, in a forwardly direction until the pressure of sheet stream gradient near the discontinuity peak 2 depresses the electrical switch activation element 42. The switch element 42 depression causes the switch contacts to open thereby removing power from the conveyor motor 7. The overall result is to stop the sheet stream advancement such that the vacuum wheel is able to properly remove sheets from the sheet stream 14. This cycle is continually repeated as the vacuum wheel 17 removes individual foremost sheets 14*a* and the conveyor motor 7 adjusts the sheet stream forward.

Referring again to FIGS. 5 and 6 it is noted that the sensing and control device 10 remains horizontally stationary while the action of both the sheet removal means 5 and the conveyor belt 16, on the sheet stream 14, causes the surface peak 2 to move in a respective horizontal backward and forward direction. It is also noted that the rearmost support roller 45*a* maintains a stable vertical position upon the upper edges of the subsequent underlapped sheets. In contrast, the foremost support roller 45*b* rests on the foremost sheet upper surface and thus follows the surface upwardly or downwardly depending if the sheet stream is advancing or being depleted respectively. In this manner the foremost roller support 45*b* pivots about the rearmost roller support 45*a* to allow the front roller 45*b* to follow the surface gradient near the discontinuity peak 2.

It should now be apparent that the block pivotal action about the screw 52*a*,52*b*, which connect the linkage members 11*a*,11*b* to the frame block 40, allows the device 10 to follow the sheet stream surface about the area of the peak 2. It is further observed that a portion of the sheet stream (the discontinuity peak 2) rises above an imaginary line tangent to both roller bottom surfaces, such portion of which is sufficient to depress the switch activation means 42. In the illustrated embodiment, as shown in FIG. 5, the sheet removal means 5 will remove sheets until the surface gradient near the discontinuity peak 2 moves rearward enough to release the pressure on the switch activation element 42 thereby energizing the conveyor motor 7. FIG. 6 indicates the situation where the conveyor motor 7 has advanced the sheet stream 14, and hence the discontinuity peak 2, forward until the foremost sheet upper surface area around the peak presses against the switch activation element 42. The switch internal contacts open and deenergize the motor 7 to stop sheet stream advancement. In the event the switch wires 9 were connected directly to the motor 7 (no intervening relays) the switch 41 would have to be of the normally closed contact type. It should now be understood that the cooperation of the discontinuity peak 2 with the switch activation member 42 dictates the manner in which the switch contacts control the motor 7. As a result of the foregoing the movement of the discontinuity peak 2 is captured between the support rollers 45*a* and 45*b*. It has been found in actual practice that the device, as illustrated, functions as described until the last sheet in an underlapped sheet stream has been delivered to the folding operation.

Figure 7:
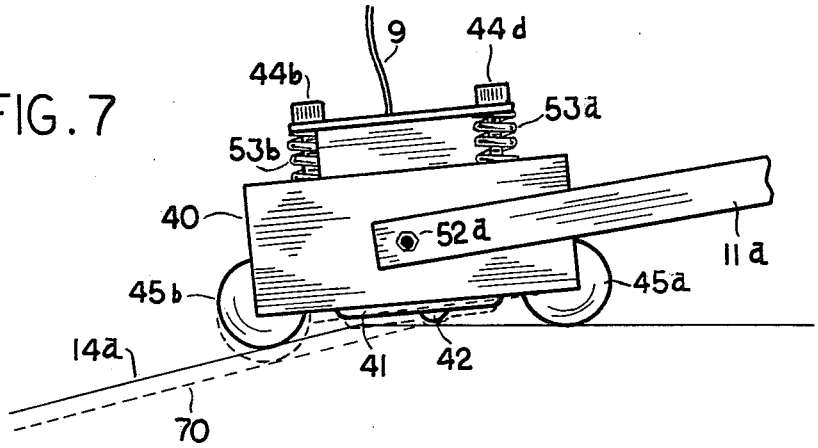
FIG. 7 is a simplified side view illustrating an alternate operational position of the device upon the sheet stream surface.

In extending the applicability of the sheet stream sensing and control device 10, it should be understood that the switch activation device may also be made responsive to the upper edges of the subsequent underlapped sheets rather than the upper frontal surface of the foremost sheet as shown in FIG. 7. In this manner the switch means 41 would be of the normally open contact type such that as the discontinuity peak 2 advances forward (conveyor motor energized) the foremost roller support 45*b* would ride up on the foremost sheet upper surface (illustrated in FIG. 7 by foremost sheet 14*a*). This action causes the frame body 40, and thus the switch 41, to rise thereby relieving the discontinuity peak 2 pressure on the activation element 42 and opening the electrical circuit to the motor to interrupt sheet stream advancement. Correspondingly, as the sheet removal means 5 depletes the foremost sheets, as shown by the dotted line 70, the discontinuity peak 2 moves in a direction toward the activation element 42 and eventually the upper edges, in the area of the discontinuity peak 2, apply sufficient pressure to depress the element 42 to thereby close the electrical circuit to the motor 7 thus advancing the sheet stream 14 forward.

ALTERNATIVE USE IN CONTINUOUS FLOW SHEET FEED SYSTEMS

While the illustrated embodiment is described in applications involving sheet feed systems supplying sheets in an interrupt movement fashion, the invention is equally applicable to a continuous flow adjustable speed sheet feed system. Applying all the sensing and control device operational principles as heretofore discussed, such an adjustable speed continuous flow sheet feed system can be controlled by utilizing two of the described sheet stream sensing and control devices. In such an alternative application the two devices are positioned one beside the other and horizontally staggered. The staggering may be easily accomplished by different adjustments of the short connecting arm 62 as noted in FIG. 2. Each electrical switch means 41 may be equipped with a normally open internal contact arrangement. A conveyor speed control means is electrically interposed between the individual device electrical wires 9 and the conveyor motor.

In operation, the foremost device senses the appearance of the sheet stream discontinuity peak when the advancement rate is greater than the rate of removal by the sheet removal means. This condition is transmitted to the motor speed control means, via a switch contact closure, to allow the control means to take the steps necessary to slowly reduce the conveyor motor speed until the discontinuity movement eventually opens the contacts of the foremost sensing and control device. In the event the motor speed is reduced in an excess amount whereby the sheet removal rate exceeds the sheet advancement rate, the discontinuity peak will cause the rearmost device contacts to close. This closure is transmitted to the motor speed control means to slowly increase the motor speed until the rearmost sensing device's open contact indication is transmitted to the control unit. This closed loop system continuously monitors the general end point travels of the discontinuity peak to maintain a position between the first and second switch activation elements.

While the above-referenced motor speed control means is not specifically disclosed, it would be obvious to those skilled in the art what components would comprise such a speed control device. For instance, various solid state building blocks may be logically connected to control the many motor speed control schemes as indicated at pages 431–460 of Electronics Circuits Manual, authored by John Markus and published by McGraw-Hill Book Company in 1971.

Figure 8:
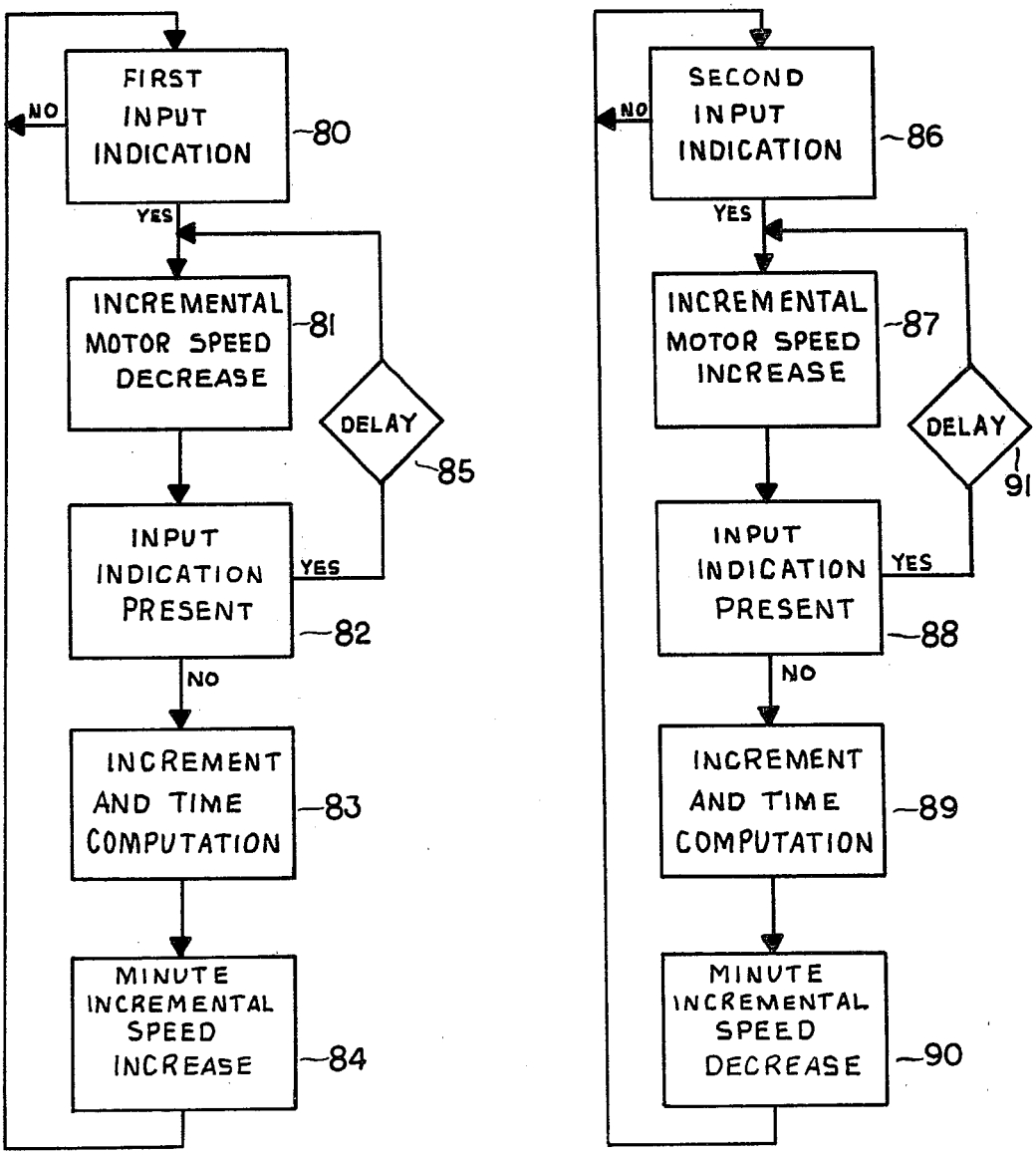
FIG. 8 is a flow chart which generally indicates the functional operations of the motor speed control utilized in conjunction with the sensing and control device to control a continuous movement adjustable speed sheet feed system.

FIG. 8 illustrates the motor speed control operational functions of a mode somewhat more sophisticated than heretofore described. Block 80 and 86 indicate switch contact open and closure detection devices each of which is electrically connected to the foremost and rearmost sensing and control devices. In the event the sheet stream advancement rate exceeds the sheet removal rate the foremost sensing device detects the discontinuity peak 2 and transmits the contact closure to the control unit first input 80. The speed control unit 81 incrementally decreases the motor speed by a known unit (or units) and checks 82 to determine if the first input contact closure has disappeared. If the contact closure is yet present at the first input, the control unit waits a predetermined amount of time 85 before incrementally decreasing the motor speed again. This action continues until the foremost device contacts have opened thus indicating the sheet stream discontinuity peak 2 position has been restored between the sensing and control devices. However, since the sheet stream advancement rate has been decreased below the sheet removal rate the conveyor motor speed must be compensated upwardly such that the discontinuity peak 2 does not continuously oscillate between the foremost and rearmost devices.

This compensation is accomplished by the decision block 83 which considers the number of increments in which the motor speed has been decreased and the number and length of time intervals therebetween. These known quantities are used in calculating the previous amount of excess advancement rate to thereby minutely increase 84 the motor speed thus stabilizing the discontinuity movement between the two devices. Illustratively, the incrementing function could be carried out by an error signal (the first input indication) causing a ripple counter to start upcounting. The counter output positive pulses individually increase the motor speed while the logic zeroes represent the time delays. It is then a simple matter to store the count, at the time the switch contacts open, and make an approximation as to the amount of speed increase 84 to stabilize the discontinuity peak movement. Of course, the described motor speed control works best where there are no extreme differences between the rates of sheet removal and advancement.

The decisional functional blocks 86–91 operate in a manner as similarly described except the second input 86 indicates the sheet stream requires an increase in advancement speed.

While the foregoing is described in terms of two separate staggered sensing and control devices, an alternative arrangement may include two electrical switches mounted in a staggered fashion within one longer frame body.

Figure 9:
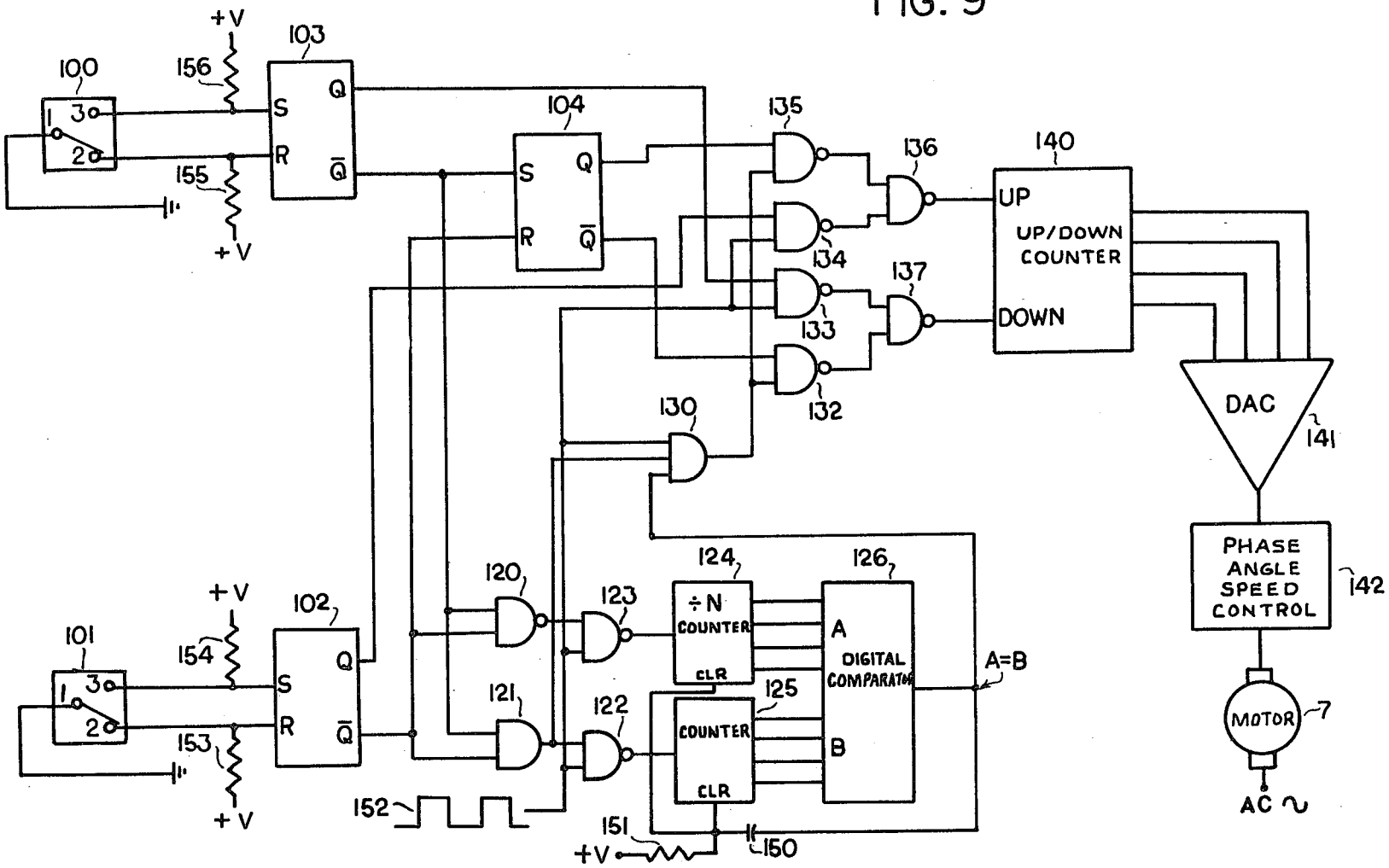
FIG. 9 is a circuit diagram of the motor speed control utilized in controlling sheet stream advancement in a continuous movement sheet feed system.

Turning now to FIG. 9, there is shown an illustrative example of a conveyor motor control circuit capable of carrying out the functional aspects of FIG. 8. In particular, the double pole switches 100 and 101 depict the internal switch contact arrangements of the foremost and rearmost sensing and control devices respectively in positions not activated by the discontinuity peak 2. Flip-flops 102 and 103 are switch contact debouncers which eliminate contact chatter as a contact is being established.

The size of motor speed incrementing or decrementing is determined by the digital pulse source 152 which is controlled and gated by the various logic gates and counters to finally increment or decrement the up/-down counter 140 to correspondingly increase or decrease the output voltage of the digital-to-analog converter 141. The converter output in turn controls the motor speed via the phase angle motor speed control circuit 142.

It should be understood throughout this discussion that while the discontinuity peak 2 advances to thereby affect the foremost device switch contacts 100 the rearmost contacts 101 remain open, to wit; the pole 3 is pulled up to a logic high by resistor 154. The other resistors 153,155 and 156 provide a similar pull-up function when the associated pole is ungrounded. The reset input of flip-flop 102, being low, causes the Q output to be low thus disabling the pulse source 152 at gate 134 from affecting the "up" input of the up/down counter 140. Flip-flop 102 Q output presents a high to the inputs of gates 120,121 and the reset input of flip-flop 104 to thus render control of the circuit operations to the action created by flip-flop 103.

Proceeding now with the description, in the event the sheet stream discontinuity peak 2 advances at a rate exceeding that of sheet removal, the discontinuity peak's surface pressure will cause the foremost device contacts 100 to close thereby forcing a ground on the normally open contact pole 3. In response thereto, the Q output of the associated flip-flop 103 is forced to a logic high which, through gates 133 and 137, allows the pulse source 152 to decrement the up/down counter 140. The digital-to-analog converter 141 being connected directly to the up/down counter 140 output, decreases the input voltage to the motor phase control 142 to thereby decrease the motor speed.

Simultaneously, flip-flop 103 Q output inhibits, via gate 121, the pulse source from incrementing counter 125 and enables, via gate 120, the pulse source to increment the divide-by-N counter 124. Eventually the conveyor motor speed, which is being incrementally reduced (the specifics of which will be discussed below), causes switch 100 contacts to return to the position wherein pole 2 is grounded thus resetting flip-flop 103 and enabling counter 125 via gate 121 (noting that flip-flop 102 has not been disturbed and thus the Q output is high). The peak 2, now restored between the devices, allows the pulse source 152 to start incrementing counter 125 while the divide-by-N counter 124 is not disturbed because the output of nand gate 120 is at a logic low. It must be understood that both flip-flop 102 and 103 Q outputs being low corresponds to a discontinuity peak position between the two sensing devices. Also, the divide-by-N counter 124 stores the number of pulses, divided by a preselected integer, that were previously directed to decreasing the motor speed, The integer N of counter 124 may be manually or automatically preprogrammed, by circuitry not shown, such that the division is sufficient to maintain the discontinuity peak 2 between the devices without undue oscillations therebetween.

The outputs of counter 125, being previously cleared to zero in a previous cycle, and counter 124 having an unequal count, establish an unequal input to the digital comparator 126 which in turn causes its output to be a logic high. This logic state in conjunction with the logic high on lead 149 (output of and gate 121), allows pulses 152 to be inputted to gates 132 and 135. Flip-flop 104 determines which of these two gates will pass the pulses to either the "up" or "down" inputs of up/down counter 140. In essence, flip-flop 104 remembers which switch 100 or 101 was the last to be actuated by the peak 2. In this example switch 100 was the last actuated switch which indicated a sheet stream speed in excess of the sheet removal rate. The initial pulse train decreased the motor speed, but necessarily too much in order to bring the peak 2 between the two devices. Thus flip-flop 104 was set by flip-flop 103 thereby causing flip-flop 104 Q output to be high. This logic high enables gate 135 to pass pulses to increase the up/down counter 140 output count an amount smaller than originally decreased. This "smaller amount" may be experimentally arrived at by varying the division of the divide-by-N counter 124 until the discontinuity peak 2 remains rather stable between the two sensing devices.

It is seen that after the peak 2 is again brought between the devices the motor speed must be minutely adjusted in the opposite direction to stop the discontinuity peak 2 drift movement between the devices. Referring again to the digital comparator circuitry, it is seen that, in the process of minutely incrementing the up/-down counter 140, gate 121 is enabled by flip-flop 103 being reset, and the pulse source 152 starts incrementing counter 125. But at the same time the pulses 152 increment the up/down counter 140 due to gate 130 being enabled by the comparator 126 which has unequal digital inputs on A and B. As the pulse source 152 continues incrementing counter 125 the outputs will eventually equal that of counter 124 in which case the digital comparator 126 will force its output low thereby disabling gate 130 and thus removing the pulse source 152 from the up/down counter 140 "up" input. The motor speed, now having been minutely increased, should maintain the discontinuity peak 2 between the two sensing devices. In addition, after the digital comparator 126 output goes low in response to input A and B equality, the logic low forces both counters 124 and 125 into a cleared state through the combination circuitry of the capacitor 150 and the resistor 151. This clearing readies the counters for storing digital information representative of a new discontinuity peak error condition.

It is not necessary to discuss the logic analysis of the circuit operation when the discontinuity peak 2 activates switch 101 as circuit principles, heretofore discussed, may be applied to FIG. 9 to understand the similar circuit operation.

In sheet feed systems having discontinuity peak movement characterized by erratic peak movement outside the detection limits of the two staggered switch means a third and/or fourth sensing and control device may be situated upon the sheet stream surface outside the sensing limits of the first and second devices to monitor for the presence of the peak 2 and thus indicate an out of control situation. In this manner when the device detects the presence of the peak 2 the output indication is transmitted to the control to override any first or second device indication and control the motor speed in a corrective direction until the quiescent operating position is again restored. At this time control is again relinquished to the first and second sensing and control devices.

The terms "horizontal" and "vertical" as used in this disclosure are not intended to limit the use of the sheet stream sensing and control device to sheet feed systems having sheet stream flows in strictly these directions. On the contrary, the device is equaly applicable to inclined conveyor transport systems.

In addition, the electrical switch means 41 may also be substituted with a light operated or photo-operated switch. Using this approach, a shoe element may be movably fixed to the block 40 to ride upon the sheet stream surface to move vertically to respond to the discontinuity peak 2 thereby breaking an associated light beam to transmit indications of the position of the discontinuity peak 2. Moreover, a magnetic proximity switch may also be utilized whereby the switch assembly itself is rigidly fastened to the sensing device frame body 40 and is magnetically actuated by the proximity of the metal shoe which is brought close to the switch assembly in response to the pressure on the shoe by the presence of the discontinuity peak 2. Such a proximity switch suitable for use is the Micro Switch switch number FYAA3A1-2 available as heretofore noted. These last-mentioned switches are not intended to exhaust all possible switch-type applications but rather are only examples of the many types of applications available.

The arrangements described throughtout this disclosure are of course merely illustrative of the applications of the principles of the invention. Numerous other arrangements may be devised by those skilled in the art without departing from the spirit and scope of the invention.

I claim as my invention:

1. A sheet stream sensing and control device adapted for use in a sheet feed system having a sheet transport for advancing a reclining sheet stream toward a sheet removal means, said sheet stream having a foremost sheet with its frontal surface exposed to said removal means and subsequent underlapped sheets each projecting under the sheet ahead of it, and a surface discontinuity peak defined where the upper edge of the foremost sheet joins the upper edges of said subsequent underlapped sheets, comprising:

means for controlling said transport to advance and stop said sheet stream;

electrical switch means for detecting the presence of the discontinuity peak, said switch means including a pressure sensitive activation mechanism, wherein the discontinuity peak movement in the advancing direction applies pressure to said activation mechanism to activate the control means to stop sheet stream advancement;

first and second support means for supporting said switch means upon the sheet stream surface, said first and second support means being fixed respectively in the front and the back of said switch means so that said first support means rests upon the foremost sheet surface and said second support means rests upon the upper edges of said underlapped sheets, whereby the discontinuity peak forward movement between said first and second support means occasioned by sheet stream advancement is stopped when said discontinuity peak presses against said activation mechanism, and discontinuity peak backward movement continues until the pressure on said activation mechanism is relieved by sheet depletion;

linkage means for constraining said switch means in the horizontal direction of sheet stream flow to thereby establish a sheet stream quiescent operating position with respect to said sheet removal means, said linkage means further including means for allowing said switch means complete freedon of vertical movement.

2. The sensing and control device as set forth in claim 1 wherein said first and second support means are each comprised of a roller.

3. A sheet stream sensing and control device adapted for use in a sheet feed system having a sheet transport for advancing a reclining sheet stream toward a sheet removal means, said sheet stream having a surface discontinuity peak defined where the foremost sheet upper edge joins the upper edges of the subsequent underlapped sheets, comprising:

detector means for detecting the movement of said discontinuity peak beyond a limit point;

first and second support means, resting respectively upon the foremost sheet surface and the upper edges of said subsequent underlapped sheets, for supporting said detector means above the sheet stream surface in such a manner that said detector means is operative to detect the movement of said discontinuity peak between said first and second support means when the peak moves beyond said limit point;

linkage means for constraining said detector means in the horizontal direction of sheet stream flow to thereby establish a sheet stream quiescent operating position with respect to said sheet removal means, said linkage means further including means for allowing said detector means complete freedom of vertical movement;

control means, responsive to said detector means, for controlling the movement of the sheet stream so as to maintain said quiescent operating position.

* * * * *